US007293655B2

(12) United States Patent
Messinger

(10) Patent No.: US 7,293,655 B2
(45) **Date of Patent: *Nov. 13, 2007**

(54) SINGLE PIECE ORGANIZER

(76) Inventor: Samuel Messinger, P.O. Box 402861, Miami Beach, FL (US) 33140

( * ) Notice: Subject to any disclaimer, the term of this patent is extended or adjusted under 35 U.S.C. 154(b) by 0 days.

This patent is subject to a terminal disclaimer.

(21) Appl. No.: 11/119,091

(22) Filed: Apr. 29, 2005

(65) Prior Publication Data

US 2005/0183985 A1 Aug. 25, 2005

Related U.S. Application Data

(63) Continuation of application No. 10/622,760, filed on Jul. 18, 2003, now Pat. No. 6,945,404.

(51) Int. Cl.
*B65D 81/02* (2006.01)
*B65D 85/20* (2006.01)

(52) U.S. Cl. ..... 206/586; 206/446; 206/588; 206/592

(58) Field of Classification Search ..... 206/521, 206/586–588, 591–592, 562–564, 761, 765; 229/147, 125.19, 125.28, 125.29, 125.32
See application file for complete search history.

(56) References Cited

U.S. PATENT DOCUMENTS 1,981,724 A * 11/1934 Donovan, Jr. ..... 206/761
1,981,847 A * 11/1934 Donovan, Jr. ..... 206/761
2,072,371 A * 3/1937 Kaplan ..... 229/125.28
2,556,844 A * 6/1951 Istwan ..... 206/562
2,593,430 A * 4/1952 Frankenstein ..... 206/521
2,841,277 A * 7/1958 Paige ..... 206/587
2,970,742 A * 2/1961 Fleisig ..... 229/125.28
3,499,595 A * 3/1970 Brooks ..... 206/563
3,820,708 A * 6/1974 Sieffert ..... 229/147
3,820,709 A * 6/1974 Sieffert ..... 229/147
3,836,066 A * 9/1974 Del Priore et al. ..... 206/521
3,894,632 A * 7/1975 Sieffert ..... 229/147
3,895,712 A * 7/1975 Sieffert ..... 229/147
5,372,259 A * 12/1994 Suzuki et al. ..... 206/586
5,501,339 A * 3/1996 Suzuki et al. ..... 206/586
5,540,330 A * 7/1996 Lo Duca ..... 206/446
5,871,147 A * 2/1999 Smith et al. ..... 206/564
6,945,404 B2 * 9/2005 Messinger ..... 206/586

* cited by examiner

*Primary Examiner*—Bryon P. Gehman
(74) *Attorney, Agent, or Firm*—Mintz, Levin, Cohn, Ferris, Glovsky and Popeo, P.C.

(57) ABSTRACT

A revolutionary single piece organizer for storing or shipping objects without damaging the object. The organizer having a unitary, one piece stiff, bendable and deformable blank having a thickness. The blank having a bottom panel, a top panel, two side panels connected to each one of the top panels and the bottom panel, two end panels connected to each side panel, and at least one flap connected to each one of the top and bottom panels. Each flap includes at least one folding section separated by scoring lines. In addition, each folding section includes multiple perforations lines that can be easily broken. The single piece organizer is assembled as a box, and the flaps, when folded, will then lock the objects to be stored or shipped. The configurations thus formed would prevent the objects from moving inside the organizer. The organizer may be preformed or customized with pre-cut holes or perforations in order to secure fragile or high-priced objects or goods. In addition, the present invention also refers to a portable organizer for storing or displaying objects. The revolutionary portable organizer may be integrated into a normal storage box.

5 Claims, 6 Drawing Sheets

50C
50B
50A
30
170
150
100
120
50A'
50B'
50C'
130
70
60
140
45
40
160
150
150
150

SINGLE PIECE ORGANIZER

RELATED APPLICATIONS

This application is a continuation of U.S. Ser. No. 10/622,760, filed Jul. 18, 2003, now U.S. Pat. No. 6,945,404 which is incorporated herein by reference in its entirety.

BACKGROUND OF THE INVENTION

1. Field of the Invention

The present invention concerns to an organizer for storing objects and goods in a secured manner. More specifically, the present invention concerns an organizer for maintaining objects of various sizes in a desired position during shipping or storage to prevent damaging of the objects.

2. Description of the Related Art

Private parties, individuals, manufacturers, and sellers usually use boxes or containers to store and ship their products. In addition, these companies or individuals often desire to position those products inside the shipping container in a manner that avoids unrestrained movement.

Many of the products are usually damaged because of impacts, road vibration, negligent dropping(s) during loading and/or unloading, and also because of the movement of the vehicles transporting these boxes or containers. To prevent damage of the packed goods, manufacturers, and sellers usually place or insert filler materials such as Styrofoam, peanuts, foam rubber, plastic, crushed newspapers, and air bubbles to avoid the products from being loose inside the box or container.

One disadvantage of the use of filler materials is that these filler materials do not entirely prevent the movement of the product inside the container. In addition, the filler material is clumsy to insert and creates too much of a mess for the shipper and recipient.

Another disadvantage is that the shippers must retain a large storage area for the filler materials, which render the method of packaging uneconomical. Furthermore, the recipient must dig through the filler material to remove the object from the container.

Furthermore, even a very small fragile object to be shipped would require a large amount of filler material to secure the object to be shipped.

Finally, the filler materials are not biodegradable and pollute the eco system.

The prior art shows several shipping containers that have been developed in an attempt to solve the problem of shipping products without damaging the products.

U.S. Pat. No. 4,129,247, entitled "Die-Cut Carton with Built-In Filler" to McCall discloses a sheet of corrugated material die-cut and scored into a one-piece blank formable into a closed carton for book shipping. The patent includes integral corner fillers, which are formed and strategically located automatically upon erection of the walls of the box.

U.S. Pat. No. 4,635,815, entitled "Reinforced Bulk Material Container" to Grigsby discloses a container having support members made of wood, which are positioned near the corners of the container.

A disadvantage presented by the container of the prior art is that each container is specifically manufactured to custom fit a specific object, thus the shipper cannot pack different products using the same container.

The present inventor has seen the necessity of providing a shipping container that can be configured to be used with various sizes, height, depth, and thickness of products, and at the same time, protects the product to be shipped.

In addition, the present inventor thought of the necessity of providing a shipping container that is easy to manufacture, and at the same time, protects the product without the use of auxiliary filler material.

SUMMARY OF THE INVENTION

It is an object of the present invention to provide a shipping container that can be configured to be used with various sizes, height, depth, and thickness of products, and at the same time, protects the product to be shipped.

It is yet another object of the invention to provide a shipping container that is easy to manufacture, and at the same time, protects the product without the use of auxiliary filler material.

It is yet another object of the present invention to provide a shipping container that is lightweight; thus, the shipping cost is substantially reduced.

It is yet another object of the present invention to provide a method for packing shipped product in a box, and at the same time, restrain the movement of the product to prevent damage of the product.

It is a further object of the present invention to provide a portable organizer for packing a product in the organizer itself without the use of a standard box type configuration having sides.

It is a further object of the present invention to provide a shipping container that is reusable.

It is a further object of the present invention to provide a shipping container that is biodegradable.

The present invention is directed to a single piece organizer for organizing, shipping, and storing objects. The organizer comprising:

- a unitary, one piece stiff, bendable and deformable blank having a thickness;
- wherein the blank comprises:
- a bottom panel;
- a top panel;
- two side panels connected to each one of the top panel and the bottom panel;
- two end panels connected to each side panel;
- at least one flap connected to each one of the top and bottom panels, wherein each flap includes at least one folding section separated by scoring lines;
- wherein the at least one folding section includes multiple perforations lines that can be easily broken.

The single piece organizer, according to the present invention, further comprises a second perforation line located between the flap and each one of the end panels.

The bottom panel when assembled with flap(s) is folded at a 90 degree angle into the side panel, wherein the end panel is folded at a 90 degree angle into the side panel to form a 90 degree angle with bottom panel, wherein the other side panel is folded 90 degrees inwardly to the end panel and at right angle to bottom panel; wherein the end panel is then folded 90 degrees inwardly to the side panel and at right angles to bottom panel forming a box.

In addition, the organizer further includes at least one adhesive/Velcro flap attached to the outermost edge of the flap. The adhesive/Velcro flap folds under the assembled flap to secure the flap into a specific location.

Furthermore, the multiple perforations are deformed when the object is placed inside the organizer.

The blank is produced by a die-cutting operation of a flat, stiff, unitary sheet.

In another embodiment, the present invention concerns a portable organizer for storing or shipping objects. The organizer comprises:

a panel;

at least one flap connected to the panel, wherein each flap includes at least one folding section separated by scoring lines;

wherein the at least one folding section includes multiple perforations lines that can be easily broken.

Furthermore, the portable organizer comprises a cover having:

a second panel;

two side panels connected to the second panel;

at least one flap connected to each one of the side panels, wherein the at least one adhesive folds into the panel locking the cover in place.

The portable organizer may be used to secure items in a home, office, school, boat or airplane. The portable organizer may be placed in a bookcase, pantry, shelf, filing area, living room, or hobby craft room. When the portable organizer is used in this manner, it may or may not be used for shipping items, but merely for securing, store or display items.

Finally, the present invention is directed to a method for storing or shipping objects in a secured manner by using the single piece organizer of the present invention.

The foregoing has outlined rather broadly the more pertinent and important features of the present invention in order that the detailed description of the invention that follows may be better understood, and so that the present contribution to the art can be more fully appreciated. Additional features of the invention will be described hereinafter, which form the subject of the claims of the invention. It should be appreciated by those skilled in the art that the concept and the specific embodiments disclosed may be readily utilized as a basis for modifying or designing other aerators for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a more complete understanding of the nature and objects of the present invention, reference should be made by the following detailed description taken in with the accompanying drawings in which.

BRIEF DESCRIPTION OF THE INVENTION

The single piece organizer 10 can be made from any substantially stiff but deformable and bendable material such as hard plastic, rubber, ply cardboard, or any types of known material suitable for storage or shipping purposes. The present invention also contemplates the idea of adding an insulated material for protection against water or moisture or the environment. Materials such as polyethylene sheet or polypropylene may also be used to provide support and reinforcement of objects to be placed therein for storage or shipping.

Furthermore, the present invention contemplates the use of a cardboard having a heat activated or fluid activated material embedded in the cardboard.

The thickness of the sheet depends on the properties of the objects and fragility of the objects that would be stored or shipped therein.

The design of the organizer of the present invention allows the shipper to ship objects of diverse shapes, fragile or non-fragile, as well as perishable objects or non-perishable objects. The present invention contemplates the using of pre-selected portions of the sheet from different composites to achieve specific engineering goals.

Figure 1:
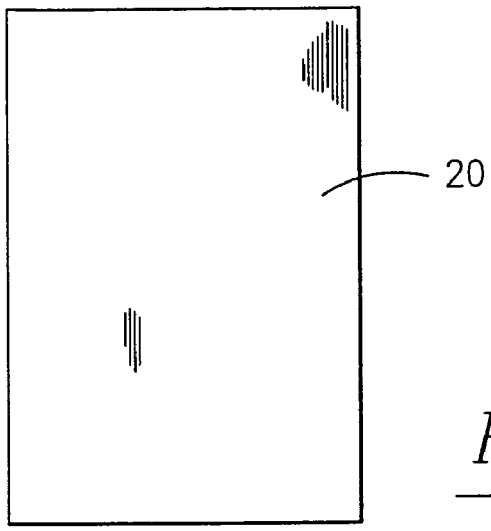
FIG. 1 is a top plan view of a blank sheet of corrugated paper from which the organizer of the present invention is formed.

The organizer is preferably by a die-cutting operation from a flat, stiff, unitary rectangular shaped sheet 20 of corrugated load bearing box paper. (FIG. 1)

The sheet 20 is cut from a continuous roll having a desired size. The size of the corrugated sheet is selected based on the dimensions and geometry of the objects to be shipped.

During the die cutting process, pre-compressed scoring lines and perforation lines are produced into the sheet.

The dimensions of the organizer are selected based upon the size and geometry of the object selected (i.e. one flap, two flaps on the bottom or one flap, two flaps, no flaps on the top).

Figure 2:
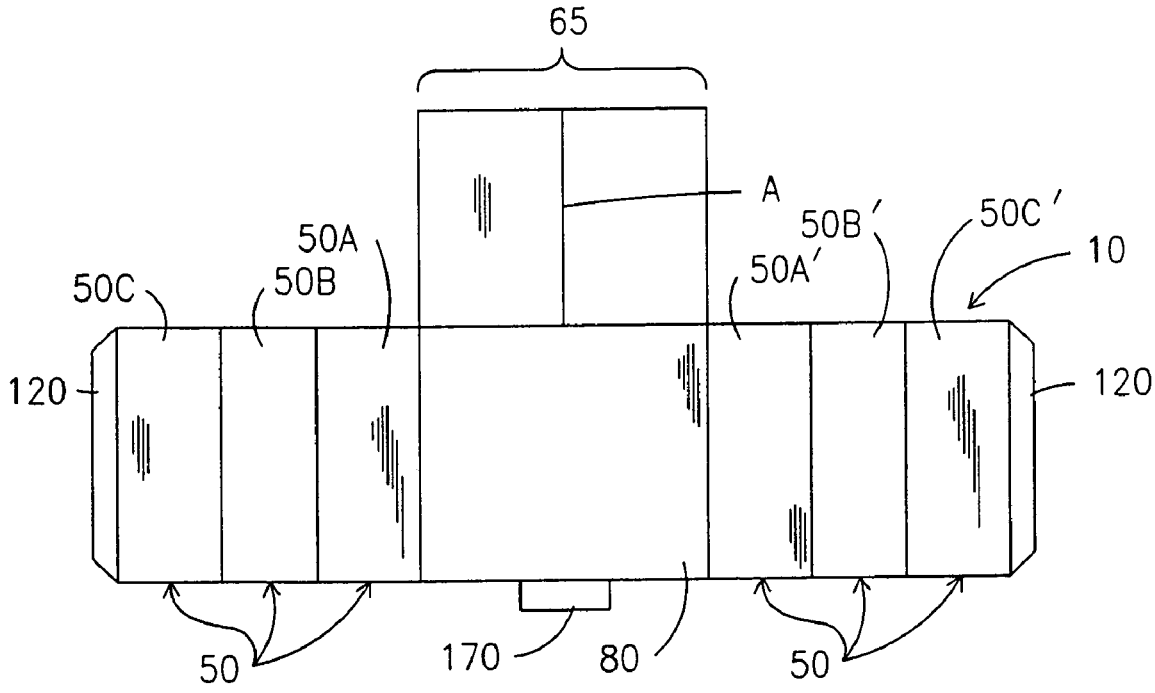
FIG. 2 is a top plan view of the organizer according to the present invention un-assembled.

FIG. 2 illustrates a top plan view of the single piece organizer 10 showing a bottom panel 80 and assembled panel 65 and flap 50 connected to the bottom panel 80. Assembled panel 65 represents the assembled panels 45, 40, 60, 70, and the top flaps of a standard box. Line A represents the open space created by top flaps of a standard box.

Figure 3:
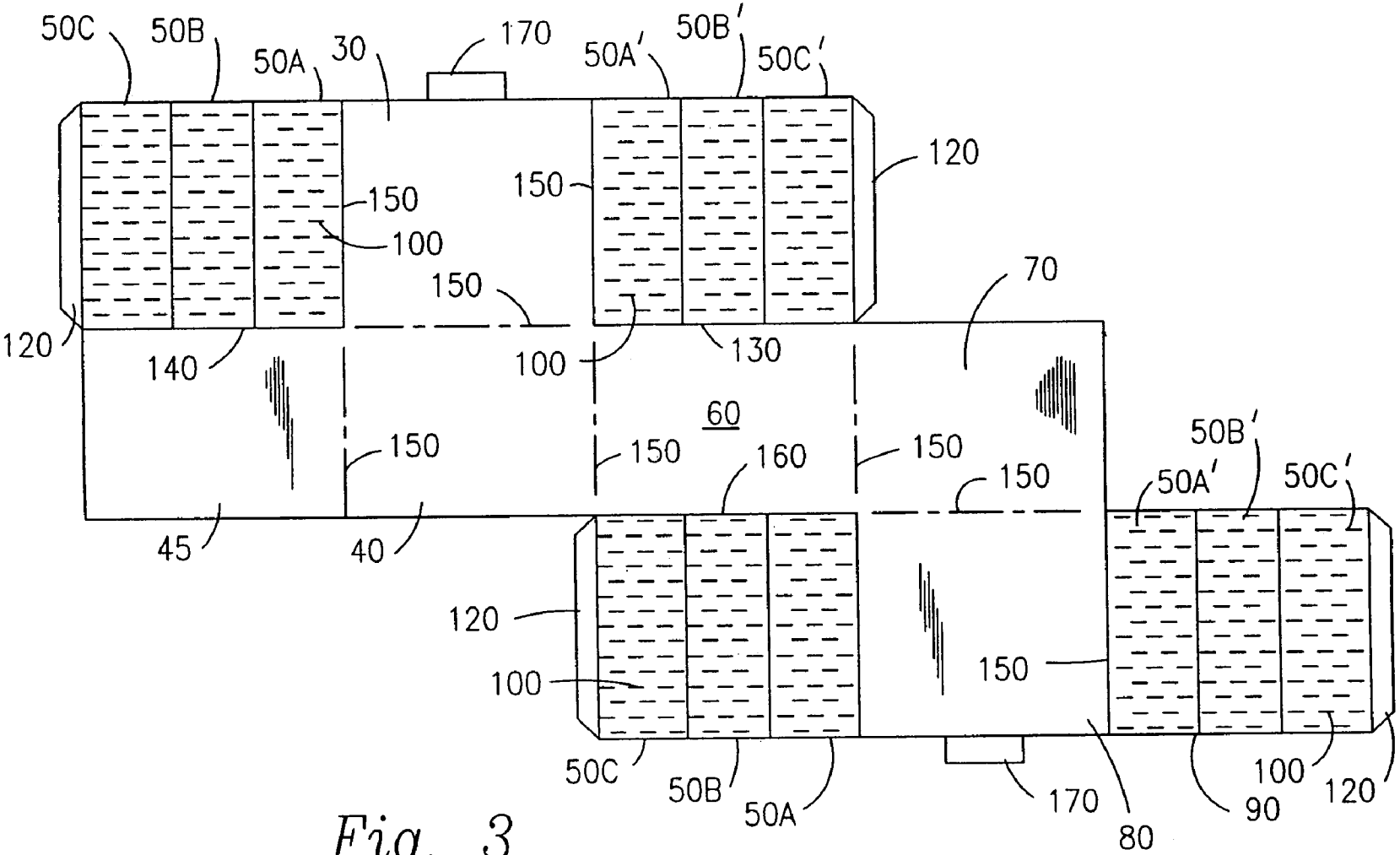
FIG. 3 a top plan view of the single piece organizer of the present invention obtained after a die-cutting operation.

FIG. 3 illustrates the die cut-blank that forms the single piece organizer 10 for storing or shipping objects according to the present invention. The organizer comprises:

a unitary, one piece stiff, bendable and deformable sheet 20 having a thickness;

wherein the sheet comprises:

a bottom panel 80;

two end panels 45, 60;

two side panels 70, 40;

a top panel 30;

at least one flap 50 connected to the top and bottom panels respectively, wherein each flap includes at least two folding sections 50 A-C and 50 A'-C', wherein the sections are separated by scoring lines 90.

The number and size of the folding sections on each flap is determined by the size of the object to be shipped or stored. The present invention illustrates an organizer having three folding sections in each flap.

In the first preferred embodiment, each folding section 50 A-C, 50 A'-C' corresponds to one-third (⅓) of the size of the bottom panel 80 or top panel 30 of the organizer and folding sections 50A-C are equaled in length with sections 50 A'-C'.

In the second preferred embodiment, each folding section 50 corresponds to one-half (½) of the size of the bottom panel 80 or top panel 30 of the organizer and folding sections 50A-C are equaled in length with sections 50 A'-C'.

In the third preferred embodiment, each folding section 50 corresponds to one-quarter (¼) of the size of the bottom panel 80 or top panel 30 of the organizer, and folding sections 50A-C are equaled in length with sections 50 A'-C'.

In the fourth preferred embodiment, each folding section 50 corresponds to the size of the bottom panel 80 or top panel 30 of the organizer, and folding sections 50A-C are equaled in length with sections 50 A'-C'.

In the fifth preferred embodiment, the bottom panel 80 or top panel 30 are of different sizes in order to hold non-symmetrical objects.

In the sixth preferred embodiment, the container does not include a top panel 30 but has at least one flap with bottom panel 80.

Each flap 50 includes multiple perforations 100 that can be easily broken to fit the object to be stored or shipped, but at the same time, the perforations are strong enough to hold the object securely. The perforation on the folding sections of the flap structurally weakens the flap to allow the flap to break away easily as the geometry of the object meets the flaps when the object is manually or mechanically assembled into the container. Thus, the perforations make it easy for the object to be placed in a snug fit and shipped without need of any air bubbles/Styrofoam/peanuts/bundled newspapers.

In addition, the present invention contemplates the use of perforations having an X, slit, pocket, hole, or snowflake design.

Those perforations having slits, holes, or those in the form of a pocket, allow protrusions from the object to project and to be suspended, thereby protecting such protrusions, which may be fragile.

Figure 6:
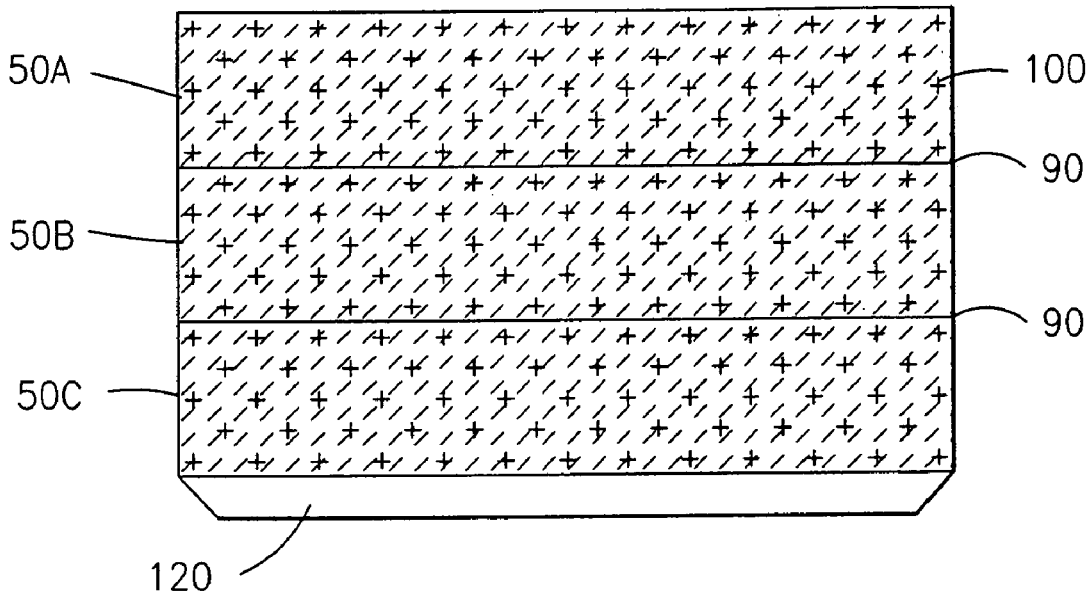
FIG. 6 is an enlarged view of the perforation of the foldable section of the flap showing a cross hatching design.
Figure 7A:
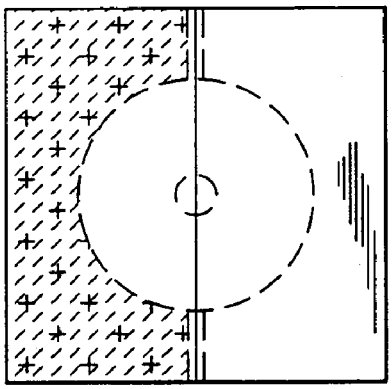
FIG. 7*a* shows a top view of the assembled organizer according to the present invention including the object being shipped.
Figure 7B:
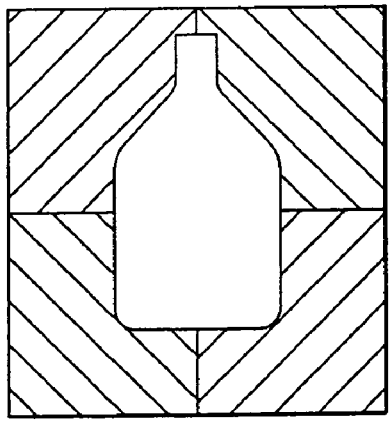
FIG. 7*b* shows a side view of the assembled organizer according to the present invention including the object being shipped showing the folding flap folded at 50%.
Figure 7C:
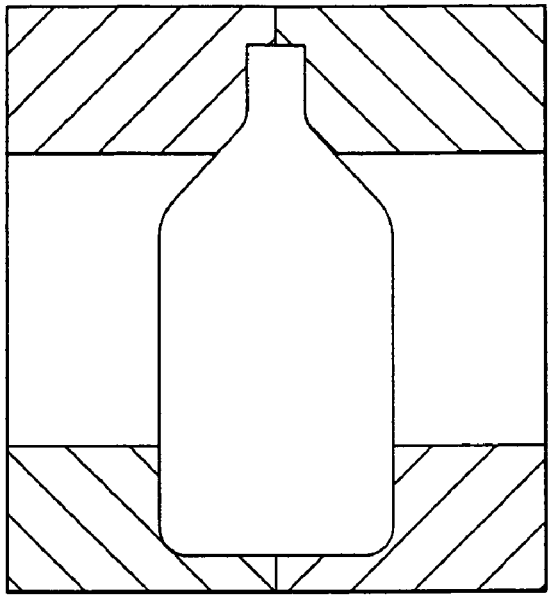
FIG. 7*c* shows a side view of the assembled organizer according to the present invention including the object being shipped showing the folding flap folded at 25%.
Figure 7D:
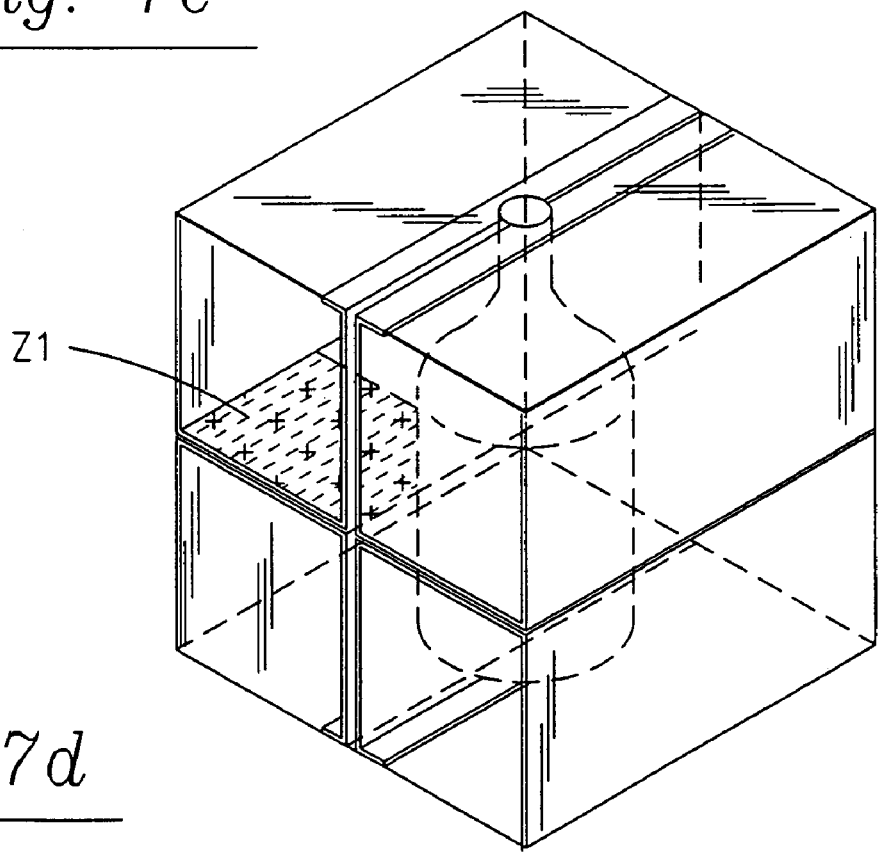
FIG. 7*d* shows a three-dimensional view of the assembled organizer according to the present invention including the object being shipped.

When using the organizer for spherical or elongated objects such as a vase or bottle, the perforations on the folding sections of each flap require cross hatching perforations to allow the corrugation to conform exactly to the geometry of the object as shown in FIG. 6. In other words, the folding sections of the flap need corrugation to break away and create a snug fit no matter what the geometry of the object.

The geometry and dimension of the inside of the organizer 10 of the present invention depends on the number and size of the folding sections 50A-C of the flap 50. The folding sections of each flap can either be equal in size or length, or have different length or size.

A feature of the present invention is that the design of the organizer provides support for the mid section of the object being shipped or stored. This is very important for elongated objects such as vases to maintain the structural integrity of the object.

In addition, the one-piece organizer according to the present invention includes adhesive/Velcro flaps 120 attached to the outermost folding section (i.e. 50C on FIGS. 2 and 3). The adhesive flaps 120 secure the assembled flap 50 into location on the bottom panel 80 and top panel 30 on the assembled organizer.

The adhesive flap 120 contains an adhesive or glue-like substance on the reverse sides for securing the folding sections to the top panel or bottom panel of the organizer. The present invention also contemplates the use of hook and loop material such as Velcro or tongue and groove to be used in securing/locating the flaps 120.

During assembly, the folding sections 50A-C of the bottom panel 80 of the organizer will be detached from the perforation line 160 in contact with panel 60. The folding sections 50 A'-C' of the top panel 30 of the organizer will be detached from the perforation line 140 adjacent with panel 45.

In the same manner, the folding sections 50 A'-C' of the bottom panel 80 of the organizer will be detached from the perforation line 160 adjacent with panel 60.

Folding section 50A folds 90° into panel 30 along line 150. Then section 50B folds 90° into 50A along line 90 (FIG. 3). Section 50C is then folded 90° into section 50B along line 90. The adhesive/Velcro is removed from the reverse side of flap 120 and fold 90° into panel 30.

Figure 4:
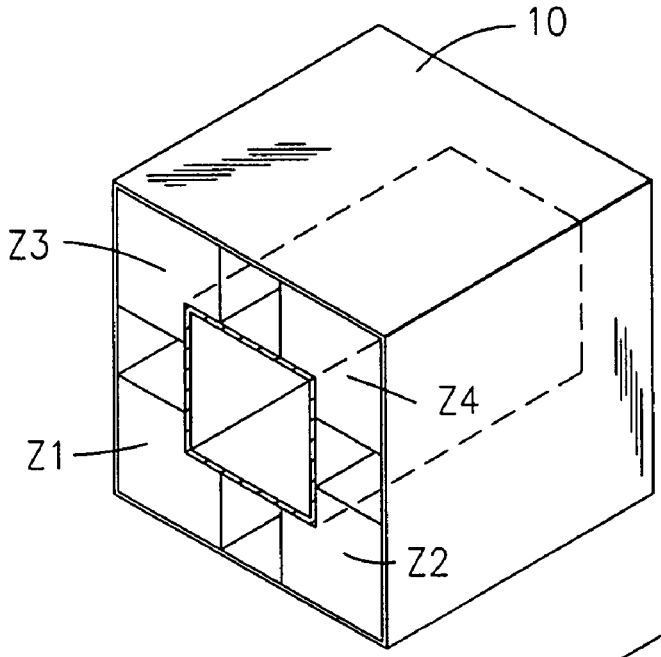
FIG. 4 is a perspective view of the single piece organizer of the present invention showing the assembled organizer including an item.
Figure 5:
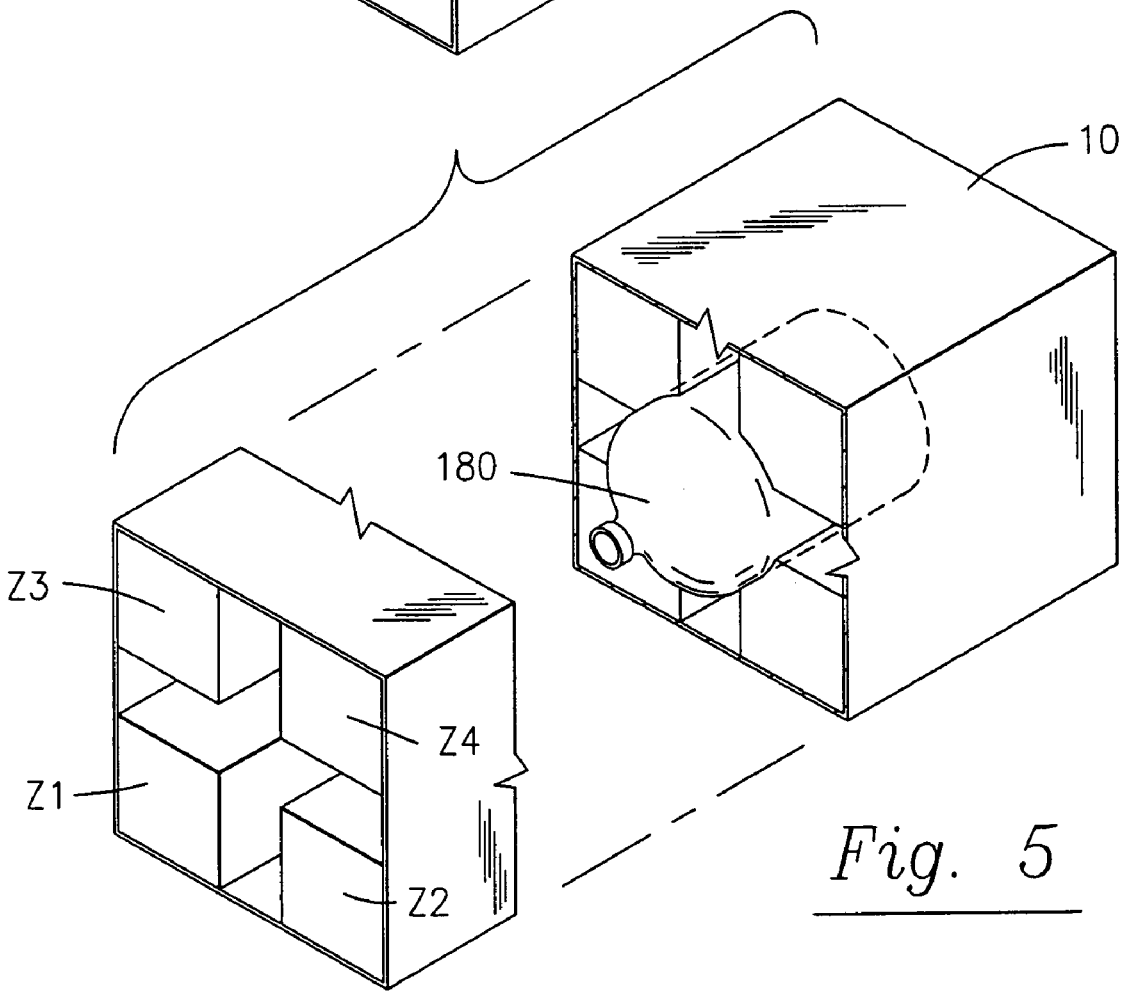
FIG. 5 is a perspective view of the single piece organizer of the present invention showing the assembled organizer including the object being shipped or stored.

With this arrangement, the object is lifted further off of the walls of the box, and at the same time, distances the object away from sides of the box. The assembled folding sections serve as further "shock absorbers" because the forces on the box are absorbed in whole or in part to reduce or eliminate the transmission of such forces to the items being shipped. (FIGS. 4-5, $Z_1$-$Z_4$)

Because of the flexibility of the folding sections, they are able to conform substantially to the item or items being shipped, which is especially useful for items having odd-shaped configurations.

After the bottom panel is fully assembled as described above, the assembled bottom panel 80 is then folded at the scoring line 150 at a 90-degree angle into panel 70.

Panel 60 is then folded at a 90-degree angle into the panel 70 to form a 90-degree angle with bottom panel 80. Panel 40 is folded 90 degrees inwardly to panel 60 and at right angles to bottom panel 80. Panel 45 is then folded 90 degrees inwardly to panel 40 and at right angles to bottom panel 80. At this point, the sides and bottom of the organizer are assembled. Thus, the seam at the intersection of panel 70 and panel 45 is closed by sealing the corner with tape, as is normally done with any standard box.

When the flaps 50 of panel 80 are folded and the sides are assembled, panels 70, 60, 40, and 45 surround bottom panel 80 to form a box of the organizer. To complete the box, the adhesive flaps 120 are locked into the panels 70 and 45.

The present invention also contemplates having an adhesive flap 170 on each one of top panels 30 and bottom panel 80 containing adhesive on the reverse side to lock the top panel and bottom panel into panel 70 and 40 respectively. The flap 170 glues into the outside or inside of panels 70 or 40 respectively. Thus, the seam at the intersection of bottom panel 80 and panel 40 is closed by sealing the corner with tape, as is normally done with any standard box. After the object is inserted into the assembled box, the top 30 is closed and the seam of 30 and 70 is closed by sealing the corner with tape, as is normally done with any standard box.

The present invention also contemplates having the top and bottom panels fit snugly into the sides of the box to increase the structural integrity of the container.

The object 180 is placed inside the organizer and securely located in the assembled bottom panel 80 of the organizer. FIG. 5.

After the top panel 30 is fully assembled as described above, the assembled top panel 30 is then folded at the scoring line 150 at a 90-degree angle into panel 40. Thus, panels 70, 60, 40, and 45 surround panel 30. Panel 40 is placed opposite to panel 70, and panel 45 is placed opposite to panel 60.

The adhesive tape on the reverse side of adhesive flap 170 locks the bottom panel 80 to panel 40 and panel 30 into panel 70.

If the shipper considers it necessary, the organizer can be taped on the outside for extra protection normally done with any standard box.

The perforations 100 can be pre-formed in the blank sheet during the die cutting operation. The scoring lines 150 provide alternative means for folding, cutting, or breaking up the sheet to accommodate a particular dimension of the objects to be stored or shipped. The resulting geometry of perforations that have conformed to the shape of the object being shipped creates a structure that forbids lateral movement as the object is squeezed between the resulting opposite cardboard shoulders.

It is possible to have the organizer so designed and so constructed that the folded sections of the flap on the bottom and top panels meet each other for further protection of contents.

Therefore, the single piece organizer will accommodate objects or goods of different sizes and dimensions.

When assembled top panel 30 of the organizer closes, the perforations 100 will be dislocated to accommodate and lock the object. In other words, the perforations will deform and crunch until the object securely locks, assuming the shape of the objects and will aid in further securing the objects that will be stored or shipped in the organizer.

In addition, the present invention contemplates inserting the flap 20 in a slot (not shown) on panel 30 that is secured with adhesive/Velcro on the reverse side.

The box can be any type of dimensions and sizes as desired. A square or rectangular box is preferred since most objects are usually shipped or stored in a square or rectangular box. But the present invention is not limited to square or rectangular shaped organizers.

The packaging technique may require that additional flaps be placed on the top portion in order to lock the objects in place and will greatly restrict lateral and vertical movement of objects stored therein.

Figure 8:
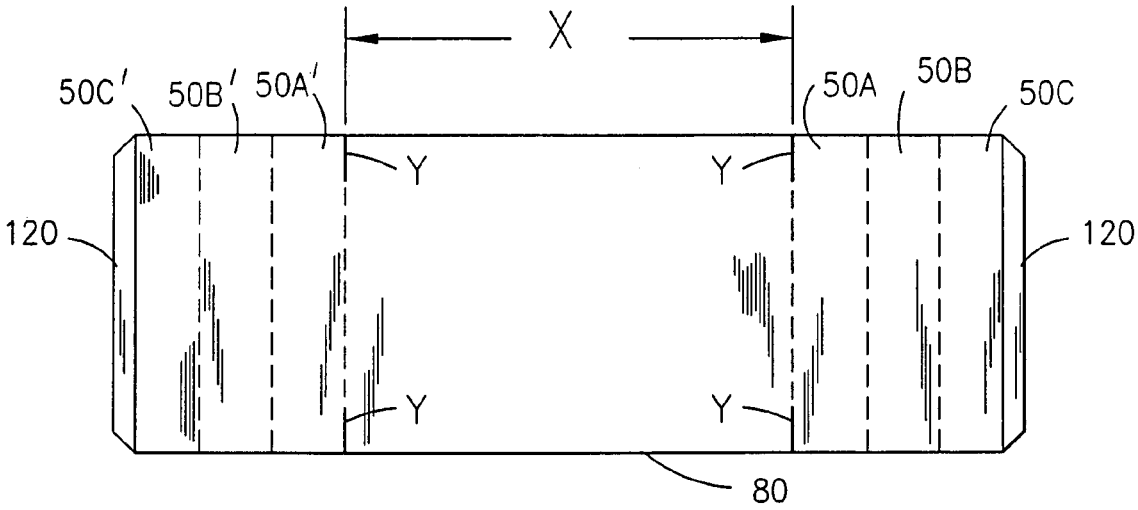
FIG. 8 shows a perspective view of the portable organizer according to the present invention.
Figure 9:
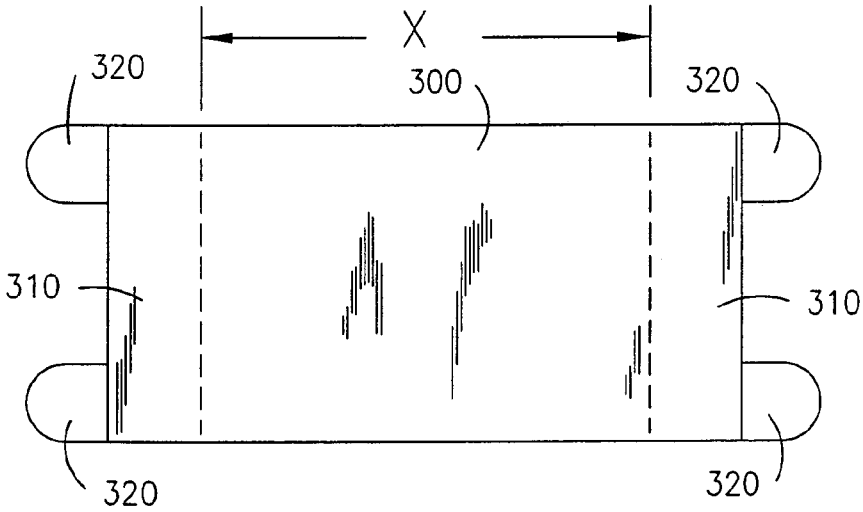
FIG. 9 shows a cover for the portable organizer according to the present invention.

In another embodiment, the present invention contemplates separating the top panel and flaps from the assembled sides of the box to provide a portable organizer having a panel, at least one flap connected to the panel, wherein each flap includes at least one folding section separated by scoring lines, and wherein the at least one folding section includes multiple perforations lines that can be easily broken. (FIG. 8)

In addition, the present invention contemplates providing a cover to the portable organizer. The cover comprises:

a second panel 300;

two side panels 310 connected to the second panel 300;

at least one flap 320 connected to each one of the side panels, wherein each flap 320 slide under an open end Y of the folding sections 50 A-C and 50 A'-C';

The top, side and bottom of the completely assembled portable organizer are closed by sealing the corner seam with tape, as is normally done with any standard box.

The use of the cover converts the portable organizer into a shipping box itself.

The portable organizer may be added to the top or bottom of any standard box to secure the objects inside the box.

This revolutionary design will allow a portable organizer that can be integrated into the packing industry with a minimum of disruption.

While the invention has been illustrated and described in the above manner, it will be appreciated that various changes can be made therein without departing from the scope and spirit of the invention.

What is claimed is:

1. A portable organizer for storing or shipping an object, the organizer comprising:

(a) a first panel;

(b) a first flap connected to the first panel, wherein the first flap includes at least one slot and a first folding section separated by scoring lines;

(b) a second flap connected to the first panel, wherein the second flap is opposed to the first flap and includes at least one slot and a second folding section separated by scoring lines;

wherein the first and second folding sections includes multiple perforations that are easily broken to conform to the geometry of an object to be stored or shipped, thereby creating a snug fit with the object;

(c) a cover, wherein the cover comprises:

(i) a second panel;

(ii) a first side panel connected to a first side of the second panel;

(iii) a second side panel connected to a second side of the second panel, wherein the first and second sides of the second panel are opposed; and (iv) at least one side-panel flap connected to each one of the first and second side panels, wherein the first and second side panels of the cover are configured to fold over the first and second flaps of the first panel and each side-panel flap is configured to slide into the at least one slot in the respective opposed sides of the first panel, whereby the assembled portable organizer forms an open sided box such that the object within the portable organizer is visible from a side adjacent to the first flap.

2. The organizer of claim 1 wherein the first folding section includes three sections separated by scoring lines and one of the three sections includes multiple perforations that are easily broken to conform to the geometry of an object to be stored or shipped.

3. The organizer of claim 2 further comprising an adhesive flap attached to the first folding section.

4. The organizer of claim 3 wherein the adhesive flap further comprises one part of a hook and loop fastener and the first panel includes the other part of the hook and loop fastener.

5. The organizer of claim 1 wherein one side of each side-panel flap includes an adhesive material.

* * * * *